US006183812B1

(12) United States Patent
Hellgren

(10) Patent No.: US 6,183,812 B1
(45) Date of Patent: Feb. 6, 2001

(54) METHOD FOR TREATMENT OF WOOD

(75) Inventor: Keijo Hellgren, Västerås (SE)

(73) Assignee: Flow Holdings GmbH (SAGL) LLC (CH)

( * ) Notice: Under 35 U.S.C. 154(b), the term of this patent shall be extended for 0 days.

(21) Appl. No.: 09/077,274

(22) PCT Filed: Dec. 20, 1996

(86) PCT No.: PCT/SE96/01724

§ 371 Date: May 27, 1998

§ 102(e) Date: May 27, 1998

(87) PCT Pub. No.: WO97/23329

PCT Pub. Date: Jul. 3, 1997

(30) Foreign Application Priority Data

Dec. 22, 1995 (SE) ..... 9504646

(51) Int. Cl.[7] ..... B05D 3/12; B05D 1/18; B27M 1/02

(52) U.S. Cl. ..... 427/325; 427/317; 427/440; 144/361; 144/380

(58) Field of Search ..... 427/317, 325, 427/440; 34/396, 398; 144/361, 380

(56) References Cited

U.S. PATENT DOCUMENTS

| | | | |
|---|---|---|---|
| 4,992,307 | 2/1991 | Ikeda . | |
| 5,678,618 * | 10/1997 | Lindhe et al. | 144/361 |
| 5,904,194 | 5/1999 | Castwall et al. | 144/361 |

FOREIGN PATENT DOCUMENTS

| | | | |
|---|---|---|---|
| 607625 * | 7/1994 | (EP) . | |
| 0 607 625 A1 | 7/1994 | (EP) . | |
| 100792 | 12/1916 | (GB) . | |
| 175444 | 5/1961 | (SE) . | |
| WO 94/26485 A1 | 11/1994 | (WO) . | |
| WO 95/13908 A1 | 5/1995 | (WO) . | |
| 95/13908 * | 5/1995 | (WO) . | |

* cited by examiner

*Primary Examiner*—Shrive Beck
*Assistant Examiner*—Michael Barr
(74) *Attorney, Agent, or Firm*—Seed I.P. Law Group PLLC

(57) ABSTRACT

A method for treatment of one or more wood elements by pressurization comprises the steps embedding the wood elements into a pressure medium, of increasing the pressure in the pressure medium, whereby the wood element is compressed by transmitting the pressure via the pressure medium to the wood elements, and of reducing the pressure in the pressure medium, whereby the wood element is relieved. During the treatment, liquid present in the wood elements is driven out therefrom. The pressure medium comprises a plurality of solid bodies with intermediate spaces. The solid bodies transmit the pressure to the wood elements such that a pressure difference arises between the wood elements and said spaces, which pressure difference drives out the liquid. During the relief phase, the wood elements substantially resume their original shape. The method can also be used for introducing impregnating liquid into the wood elements after the liquid expulsion.

19 Claims, 1 Drawing Sheet

METHOD FOR TREATMENT OF WOOD

TECHNICAL FIELD

The present invention relates to a method for treatment of one or more wood elements by isostatic pressurization, the wood element being placed in a bed of a pressure medium and the pressure medium being pressurized, the pressure medium thus transmitting the pressure to the wood element.

The method is well suited for drying of wood with a high moisture content. The method is particularly well suited for drying with a subsequent impregnation of kinds of wood which are otherwise difficult to impregnate, for example spruce.

BACKGROUND ART AND PROBLEMS

It is previously known to change the properties of wood products by pressure treatment. Pressure treatment has been used, for example, for compressing and hardening of wood. In this connection, particularly good results have been obtained by treatment by means of isostatic pressurization of the wood elements. In a previously known method, the wood elements to be treated are placed surrounded by a pressure medium in a compression chamber. The pressure medium consists of a plurality of adapted rubber elements, shaped, for example, as balls, elongated strips or cubes. The pressure medium is delimited in the pressure chamber from a working fluid, for example hydraulic oil, by an elastic membrane. By pressurizing the working fluid by means of a hydraulic pump, the worked-up pressure is transmitted to the pressure medium. The pressure medium forms around the wood elements and brings about a uniform compression thereof. This results in a permanent compression and hardening of the wood elements.

A disadvantage with the prior art is that the liquid and moisture contents of the wood elements prior to the pressure treatment must be reduced to a level acceptable for the pressure treatment. The reason therefor is that the incompressible liquid during the pressurization is contained in the wood element, whereby compression of the wood element is not possible. Thus, it has not been possible to pressure-treat freshly sawn timber or other wood products with too high a moisture ratio.

A closely related problem is that, with the previously known technique, it has not been possible to utilize pressure treatment for the very purpose of drying of wood elements. To reduce the moisture ratio of wood products, it has hitherto been necessary to use the traditional methods, which are based on heating and/or air drying by means of fans. These methods, however, are relatively time-consuming and therefore cause high costs.

Another, and perhaps even more serious problem, which is a consequence of the traditional drying methods, concerns the subsequent impregnation of the dried wood products. This often entails serious problems, since it is difficult to cause the impregnating agent to penetrate sufficiently deep into the wood. Impregnation of wood products, such as sawn timber, is often desirable. The impregnation aims at increasing the resistance of the wood products to certain processes, such as bacterial or fungus attack, causing degradation in the wood. Usually, the preserving agent is dissolved in a liquid, which by means of various methods is brought to penetrate into the wood. The penetration may be achieved, for example, by soaking the wood products or by driving in the impregnating liquid by means of an over-pressure. In the latter case, the impregnation is usually preceded by vacuum treatment of the wood products.

The penetration of the liquid into the wood may take place either by diffusion or flow. In the case of diffusion, the liquid penetrates very slowly into the wood by means of the concentration of the impregnating solution. In the case of penetration by flow, on the other hand, the liquid may quite rapidly penetrate into the wood by utilizing the fibres and pores occurring in the wood. During impregnation, flow penetration is preferable to diffusion penetration owing to the higher rate of penetration.

In coniferous wood, more than 90% of the wood consists of wood fibre, so-called tracheids. In the live tree, the purpose thereof is, among other things, to conduct liquid. The tracheids consist of about 3 millimetres long, elongated hollow fibres. They are arranged essentially parallel to the longitudinal direction of the tree and each other and are mutually axially displaced. Liquid may be transported from one tracheid to an adjacent one via so-called pores. The pores, which may be of different kind, for example ring pores or simple pores, constitute openings in the tracheid wall. The pores usually comprise some type of closing member, a so-called pore membrane. Because the pore membranes open and close the pores, liquid is allowed and prevented, respectively, from passing from one tracheid to another.

During impregnation of sawn timber, the liquid penetrates very rapidly from the end surfaces of the wood elements. The longitudinal tracheids are cut off there and the liquid enters easily. To allow the liquid to pass into the wood, from one tracheid to another, the pores must be open. Sooner or later the liquid encounters a tracheid where all the pores are closed and the penetration thus stops.

It has proved that traditional drying of coniferous wood causes closing of the pores. When the wood dries, the pore membrane is displaced from a central position and closes the pore opening. What causes the membrane to move are capillary forces in the water which is dried away. When the membrane has clogged the pore opening, it is impossible to move the membrane even if the wood is subjected to very high pressure. This is probably due to the membrane adhering to the pore wall and to the fact that a bond in the form of hydrogen bridges arises therebetween.

The above reasoning is an explanation why, after traditional drying of softwood, it is so difficult to cause impregnating liquid to penetrate sufficiently deeply into the wood. Further, it has been known for a long time that it is considerably more difficult to impregnate spruce than pine. This is due, among other things, to the fact that a larger number of pores close during drying of spruce than of pine, and to pine having fewer and smaller pores.

A special problem with previously known drying methods is thus that they render the subsequent impregnation of the wood considerably more difficult. This is particularly true of certain kinds of wood, such as spruce.

The object of the present invention is to provide a method for treatment of wood which allows pressure treatment to be used for the drying of the wood and which makes possible a considerably simplified impregnation of the dried wood.

THE SOLUTION

The above-mentioned object is achieved according to the invention with a method of the kind mentioned in the introductory part of the description and which is characterized in that the wood element (4) contains liquid, which during the compression is driven out by the fact that the pressure medium comprises a plurality of solid bodies (8*a*) with intermediate spaces (8*b*), whereby the solid bodies transmit the pressure to the wood element such that a pressure difference arises between the wood element and the mentioned spaces when the pressure medium is pressurized, which pressure difference drives the liquid from the wood element to the spaces, and that the wood element, during the pressure relief, is expanded substantially to its original shape.

Since the pressure medium comprises solid bodies, it is ensured that the spaces between the bodies are maintained also during the pressurization of the pressure medium. This makes possible the pressure difference, which is necessary for driving out the liquid, during the compression of the wood element. The method according to the invention thus allows wood elements to be dried by means of pressure treatment. Such pressurized drying is significantly faster than the prior art drying methods. Drying of freshly sawn timber to a moisture ratio of about 30%, which previously, for example in a drying furnace, took up to 24 hours, can be carried out in less than 2 minutes with the method according to the invention.

The raised pressure which is obtained during the compression phase may be maintained in the pressure medium and in the wood element during a certain predetermined holding time prior to the beginning of the pressure relief phase. In this way, it is ensured that the desired quantity of the liquid has time to penetrate out of the wood element.

The solid bodies included in the pressure medium may consist of a large number of different materials and they may have different hardness depending on under what maximum pressures they are to be used. Some materials which have proved to be particularly suitable are polymers, sand, glass, stainless steel, bronze and aluminium oxide. In those applications of the method where only lower pressures are utilized, the solid bodies may have a hardness according to the international IRH scale of IRH shore A 95° or more. If higher pressures are used, the hardness should preferably exceed IRH shore D 80°. In this connection it should be noted that the IRH shore D scale represents a higher hardness interval than the IRH shore A scale.

Further, the solid bodies may have an infinite number of geometrical shapes. They may be completely asymmetrical and mutually different, which is the case, for example, with grains of sand, but they may also be symmetrical and identical, for example as steel balls. The size of the solid bodies is of importance to the result. Too large bodies cause visible impressions in the surface of the wood element, whereas too small bodies or grains make the escape and removal of liquid between the spaces and from the wood element difficult. Attempts have shown that solid bodies with a diameter or mesh size smaller than 10 mm are suitable. Particularly favourable results are obtained if the grain size is between 0.1 and 5 mm.

The fact that the wood elements during the relief phase restore their original shape in this context means several advantages. For one thing, in many respects, the same properties as traditionally dried wood are imparted to the wood elements. For example, wood dried according to the invention exhibits no difference from other wood, from the strength point of view or any other structural engineering point of view, which makes it possible to use it as ordinary wood without further adaptation. Further, the expansion of the wood element during the relief phase contributes to make possible a significantly simpler impregnation of the wood element.

In use of the method, during the compression, a considerable proportion of pore membranes present in the wood element may be caused to leave their pores. The pore membranes are flushed away with the aid of the relatively fast flowing liquid, which was present in the wood element from the beginning and which is pressed out during the compression. As is clear from the above, the pore membranes constitute one of the most serious reasons for traditionally dried wood being so difficult to impregnate. As a considerable proportion of the pore membranes according to the invention are removed from the pores, a significant proportion of the tracheids will, after pressurization, lie open to the impregnating liquid. In this way, the resistance to impregnation by means of a flowing liquid is considerably reduced. The impregnating liquid can therefore, in a simpler and faster manner, penetrate considerably deeper into the wood than what was previously possible. The method according to this embodiment makes possible an impregnating efficiency which has not been possible at all in the past.

Further, the rate of pressure increase and the maximum pressure may be adjusted to control the proportion of pore membranes which are caused to leave their pores. This control makes possible, for example, removal of an optimum proportion of pore membranes without damaging the wood in other respects. The maximum pressure as well as the rate of pressure increase are chosen depending of the kind of wood and the dimension of the wood. Attempts have shown that pressures of between 400 and 1500 bar are often suitable. Particularly favourable results have been achieved at between 700 and 1100 bar.

Still more important for obtaining a well-balanced blow-out or flushing away of pore membranes is the rate at which the pressure in the pressure medium and the wood element is increased. The faster the pressure increase, the higher the liquid flow and the larger the proportion of removed pore membranes. Too rapid pressure increase, however, may damage the tracheids and other wood components. During tests, rates of pressure increase of between, on average, 2 and 40 bar/second, preferably between 10 and 25 bar/second have proved to be suitable.

According to one embodiment of the invention, an impregnating liquid may be allowed into the wood element during the relief. This offers a method of treatment for drying and impregnation which is considerably faster and more efficient than prior art methods. Drying and impregnation, which according to the prior art take from several hours up to several days, are carried out in just a few minutes using the method according to the invention. If a sufficiently large proportion of pore membranes are removed during the liquid expulsion, the embodiment also entails a considerably larger impregnation depth and a higher impregnation efficiency than what has been possible so far.

Further, the impregnating liquid may be supplied to the spaces in the pressure medium when the pressure medium is pressurized. The impregnation according to this embodiment takes place by driving the impregnating liquid, during the relief of the wood element, into the wood element by means of the pressure difference which arises between the spaces and the wood element during expansion thereof. In this way, a simple and efficient treatment cycle is obtained without interruption or reloading. In addition, the energy which is used for building up the liquid expulsion pressurization is utilized also for the impregnation. This renders the process considerably more effective in relation to the prior art, where the drying energy cannot be used in any way during the pressure impregnation.

BRIEF DESCRIPTION OF THE DRAWING

Exemplifying embodiments of the method according to the invention will be described below with reference to the accompanying drawings.

Figure 1:
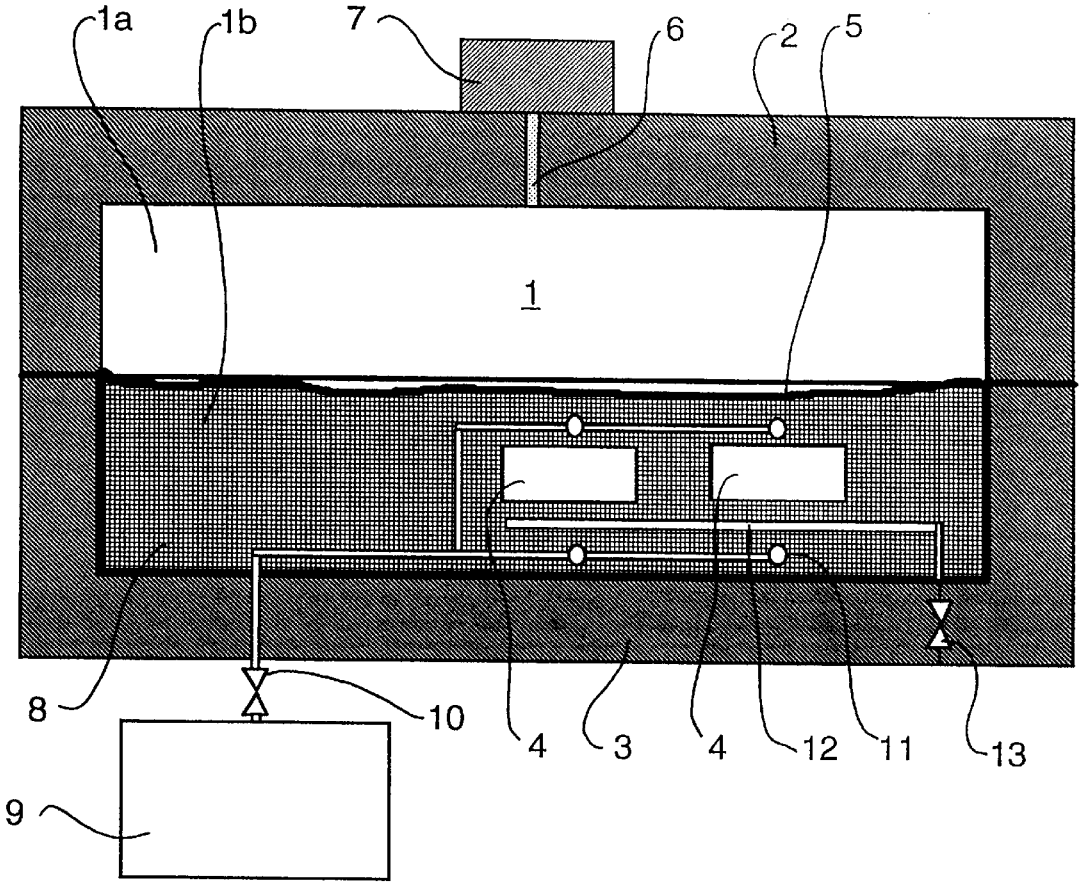
FIG. 1 is a schematic cross section through a press for carrying out the method according to the invention.

The press shown in FIG. 1 comprises a pressure chamber 1, which is defined by an upper 2 and a lower 3 part. By separating the two parts 2 and 3, the pressure chamber is opened, thus providing a possibility of inserting and withdrawing the wood elements 4 which are being treated. In the pressure chamber 1 an elastic diaphragm 5 is arranged. The diaphragm 5 is attached to the upper part 2 such that it is fixed between the upper part 2 and the lower part 3 when the pressure chamber 1 is closed and such that the lower part of the pressure chamber is exposed when the chamber is opened. When the pressure chamber 1 is closed, the diaphragm 5 delimits one primary 1*a* and one secondary 1*b* compartment. The primary compartment la of the pressure chamber communicates, via a channel 6, with a hydraulic unit 7 in the form of a high-pressure pump.

Further, in the secondary compartment 1*b* of the pressure chamber 1, two elongated wood elements 4 are arranged. These are embedded into a pressure medium 8, which completely surrounds the wood elements 4. A pressure vessel 9 for storage and pressurization of impregnating liquid, is placed outside the press and communicates, via an impregnation valve 10, with distribution conduits 11, arranged in the pressure medium, in the vicinity of the wood elements. The pressure vessel 9 is also connected to a pump (not shown) for pressurization of the impregnating liquid. The distribution conduits 11 are provided with small spray holes (not shown) and extend on two sides of each wood element along essentially the whole length of the element. Likewise, in the secondary compartment 1*b* and in the vicinity of the wood elements 4, several draining pipes 12 (only one being shown) are arranged. The draining pipes 12 are provided with openings (not shown) and communicate via a drain valve 13 with the outside of the press. Both the impregnation valve 10 and the drain valve 13 may be controlled to open and close from the outside of the press.

Figure 2:
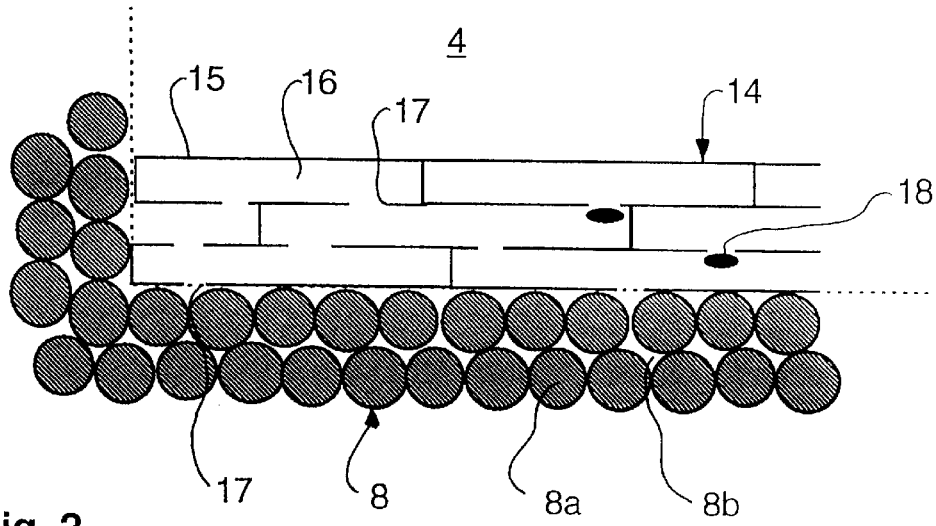
FIG. 2 is a schematic longitudinal section, greatly amplified, through part of a wood element when, embedded into a pressure medium, it undergoes a treatment according to the invention.

The part of a longitudinal section of a wood element 4, schematically shown in FIG. 2, comprises a number of elongated tracheids 14. Each tracheid comprises walls 15, an inner void 16 and openings 17 in the walls. At two of the openings, or the pores 17, a pore membrane 18 is disposed. To the left in the figure it is indicated that several of the tracheids nearest the end of the wood element are cut and have no end wall. The wood element 4 is surrounded, on the two sides shown, by the pressure medium 8. This comprises a plurality of glass balls 8*a* with intermediate free spaces 8*b*. The diameter of the glass balls is around 1 mm.

It is described below how two wood elements 4 are treated according to one exemplifying method according to the invention. When the upper part 2 of the pressure chamber 1 is removed, the wood elements 4 are lifted into the lower part of the pressure chamber 1. The wood elements 4 consist of planks of sapwood from spruce and have a moisture ratio exceeding 30%. Normally, the moisture ratio for freshly sawn sapwood of spruce is between 100 and 150%. The moisture ratio may, of course, vary depending on the kind of wood and the preceding treatment, but generally the moisture ratio before the treatment should not be too low. The moisture ratio, which is reduced during the liquid expulsion, influences the rigidity of wood. Too low a moisture content causes the wood to become more rigid, which counteracts the resumption of the original shape by the wood elements during the relief. Too low a moisture ratio may thus entail a lasting compression and hardening of the wood elements which is not desirable in this connection.

The wood elements 4 are placed on a bed of glass balls 8*a*, whereupon glass balls are poured over them so that they are surrounded by these glass balls on all the sides. Also the distribution pipes 11 are arranged in the bed, so that the spray holes become evenly distributed along the wood elements 4 and at an appropriate distance therefrom. Under the wood elements the draining pipes 12 are arranged, with the openings for draining the spaces 8*b* in the pressure medium 8. The draining pipes 12 may possibly be arranged such that a majority of the openings are concentrated in the vicinity of those locations of the wood elements 4 which, during the compression, give off more liquid, for example the short sides of the wood elements.

When the pressure medium bed is arranged, the pressure chamber 1 is sealed by lifting the upper part 2 with the diaphragm 5 onto the lower part 3 and securing it thereto. Thereafter, the hydraulic unit 7 is started, whereby hydraulic oil is pumped via the channel 6 into the primary compartment 1*a* of the pressure chamber 1. When the primary compartment is filled with hydraulic oil, the pressure is increased by pumping in additional oil. The raised pressure is transmitted via the diaphragm 5 and the pressure medium 8 in the secondary compartment 1*b* to the wood elements 4. Since the friction between the glass balls 8*a* is relatively low, an isostatic pressure arises in the secondary compartment. At the same time, the spaces between the balls are retained. The pressure which is transmitted via the diaphragm causes an equilibrium of forces between all the balls which are in mechanical contact with each other. In this way, the pressure is transmitted isostatically from the diaphragm via the balls to all the surfaces of the wood element 4. The gas pressure in the spaces 8*b* between the balls 8*a* is not changed to any significant degree during the pressure-increase phase. The atmospheric pressure which prevails prior to the start of the hydraulic unit 7 is retained in all essentials during the compression phase.

When the glass balls 8*a* now press on the surfaces of the wood elements 4, the same high pressure arises in the wood elements 4 as in the pressure medium 8. In this way, liquid, which exists freely in the voids 16 of the tracheids 15, is pressurized to this high pressure. A pressure difference thus arises between the liquid in the wood elements 4 and the spaces 8*b* between the balls 8*a* in the pressure medium 8. This difference in pressure drives liquid to move from the wood element 4 to the spaces 8*b* in the pressure medium 8. The liquid primarily leaves the wood elements through the possible outlets which cause the lowest flow resistance. Thus part of the liquid passes out through tracheids 14 which are cut off at the end of the wood elements. Part of the liquid flows out via pores 17 at the surface of the wood elements and part of the liquid diffuses out through the tracheid walls 15. During its flow from the interior of the wood elements to the surfaces thereof, liquid tears off pore membranes 18 from the tracheid walls 15 at the pores 17. The torn-off pore membranes 18 are carried with the liquid from tracheid 14 to tracheid and thus follow the liquid out of the wood elements 4.

During the pressurization, the drain valve 13 is open. Part of the liquid which leaves the wood elements 4 is transpored via the spaces 8*b* away from the wood elements and is collected by the draining pipes 12 with their draining openings. The drained-off liquid is passed via the draining pipes 12 and the valve 13 away from the pressure chamber 1. The draining of the spaces 8*b* may possibly be accelerated by vacuum suction of the spaces 8*b* with the aid of the vacuum pump (not shown), which may be connected to the drain valve 13.

To obtain a good result when driving off liquid and pore membranes during the compression phase, the pressurization rate and the maximum pressure are chosen to suit the wood elements in question. During treatment of sapwood from spruce with an initial moisture ratio exceeding 100%, the pressure is raised from atmospheric pressure by about 5 bar/second to about 900 bar. The pressurization parameters are also chosen in dependence on the available pressure medium. Thus, for example, balls of steel or aluminium oxide withstand pressures exceeding 100 bar, whereas solid bodies of, for example, polymers are not used for pressures exceeding about 500 bar.

The high pressure which is achieved during the pressurization phase is now maintained during a certain predetermined time. This is done in order to give the desired quantity of liquid ample time to penetrate out from the wood elements. The duration of the holding time varies from case to case and is determined on the basis of, among other things, the kind of wood, the moisture ratio as well as the rate of pressure increase and the maximum pressure. By choosing a longer holding time, it may be possible to allow the rate of pressure increase and the maximum pressure to be lower. This results in a treatment which, admittedly, is somewhat slower but which is also more lenient to the fibre structure in the wood.

Before or during the compression phase and the holding time, the impregnating liquid in the pressure vessel 9 has been pressurized to a pressure which is considerably higher than the pressure which prevails in the pressure medium 8 and the wood elements 4. When the compression phase and the holding time are completed, the drain valve 13 is closed. Thereafter the impregnating valve 10 is opened. The pressurized impregnating liquid thus flows out through the distribution tubes 11 and is distributed via the spray nozzles out into the spaces 8*b* near the wood elements 4. Since the pressure of the impregnating liquid in the spaces 8*b* is now higher than the pressure in the wood elements, the impregnating liquid penetrates into these. To ensure that a sufficient quantity of impregnating liquid penetrates sufficiently deep into the wood, the pressure difference between the impregnating liquid in the spaces and the wood elements is maintained for a certain holding time. When this holding time is completed, the secondary compartment 1*b* is relieved by evacuating hydraulic oil from the primary compartment. During the relief phase, the wood elements 4 again expand into their original shape. This leads to an additional pressure difference between the interior of the wood elements and the spaces 8*b* filled with impregnating liquid. This pressure difference now drives additional impregnating liquid into the wood elements. Since a considerable part of the pore membranes is flushed away, impregnating liquid may penetrate far into the wood elements without difficulty. Only a relatively small pressure difference is necessary to obtain a satisfactory impregnation, where liquid penetrates into the centre of the wood elements. The relief can be carried out relatively rapidly, whereby the pressure can be reduced by about 20–50 bar/second.

After completed relief, when the pressure in the primary 1*a* and secondary 1*b* compartments and in the wood element again is around 1 bar, the upper part 2 of the pressure chamber is removed, whereupon the wood elements can be removed.

During the impregnation, the moisture ratio of the wood again rises. Normal values of the moisture ratio, both during traditional impregnation and the method described above, are around 35–125%. If an impregnated product with a lower moisture ratio is desired, the wood elements may be dried in traditional manner. It is also possible, however, after the active components in the impregnating liquid have reacted with the wood, to dry the wood elements again by means of pressure treatment. The redundant impregnating liquid thus runs out during the compression phase, wherafter no liquid is added during the relief phase.

The method described above is only one example of treatment of wood according to the invention. The method may be varied in a plurality of different ways.

For example, wood elements of many other kinds of wood, such as pine, oak, birch, larch, beech, aspen and alder may be treated. In addition to being derived from the sapwood, the treated elements may also be derived from the heartwood or constitute a combination thereof.

The treatment is not required to include the impregnation phase, but the wood elements may be relieved without any supply of impregnating liquid. This results in a very fast and effective drying of the wood elements.

The method of supplying impregnating liquid to the spaces when the wood elements are pressurized can be varied in many ways. The impregnating liquid may, for example, be pumped in via the draining pipes. It is also possible, instead of supplying the liquid from an external pressurized container, to place a flexible container in the pressure medium bed. This flexible container is filled with impregnating liquid before the compression phase. During the compression phase the liquid is prevented from penetrating out into the bed in that the impregnation valve is closed. The liquid in the flexible container is thus pressurized to essentially the same pressure as that which prevails in the wood elements. When the compression phase with the subsequent holding time is completed, the impregnation valve is opened whereby the impregnating liquid spreads in the spaces of the pressure medium. When the liquid has spread, the wood elements are relieved whereby they expand to their original shape. This results in a pressure difference between the spaces and the wood elements which drives the impregnating liquid into the wood elements.

Further, it is not necessary to drain away the liquid which is driven out of the wood elements during the compression. It is also possible to reuse this liquid by allowing concentrated impregnating liquid, after the liquid expulsion, to mix therewith in the bed. Thereafter, the liquid with impregnating agent is returned into the wood elements during the relief.

The method of driving out the liquid from the wood element is best suited for driving out so-called free water. This is water which, prior to the drying, exists freely in the fibres of the wood and which is not bound in the cell walls of the wood.

What is claimed is:

1. A method for treatment of one or more wood elements by pressurization, comprising the steps of embedding the wood element in a pressure medium, increasing the pressure in the pressure medium, whereby the wood element is compressed by transmitting the pressure via the pressure medium to the wood element, and reducing the pressure in the pressure medium, whereby the wood element is relieved, characterized in that the wood element contains liquid which during the compression is driven out by the fact that the pressure medium comprises a plurality of solid bodies with intermediate spaces, the solid bodies having a sufficient hardness to maintain the intermediate spaces between the bodies when subjected to pressures over 400 bar, whereby the solid bodies transmit the pressure to the wood element, such that a pressure difference arises between the wood element and said spaces when the pressure medium is pressurized, which pressure difference drives the liquid from the wood element to the spaces.

2. A method according to claim 1, characterized in that the increased pressure obtained during the compression is maintained during a predetermined holding time.

3. A method according to claim 1, characterized in that a significant proportion of the pore membranes present in the wood element are brought to leave their pores.

4. A method according to claim 3, characterized in that the rate of pressure increase and the maximum pressure are controlled for controlling the proportion of pore membranes which are brought to leave their pores.

5. A method according to claim 1, characterized in that an impregnating liquid is introduced into the wood element.

6. A method according to claim 5, characterized in that the impregnating liquid is pressurized and is supplied to the spaces in the pressure medium.

7. A method according to claim 1, characterized in that the pressure medium comprises a granulate, in which the average diameter or mesh size of the solid bodies is smaller than 10 mm.

8. A method according to claim 1, characterized in that the pressure medium comprises solid bodies of polymer material, sand, glass, steel, bronze or aluminium oxide.

9. A method according to claim 1, characterized in that the wood element is pressurized to between 400 and 1500 bar.

10. A method according to claim 1, characterized in that the pressure increase takes place at a rate of, on average, between 2 and 40 bar/second.

11. A method according to claim 1, characterized in that the hardness of the solid bodies exceeds IRH shore A 95°.

12. A method according to claim 1, characterized in that the average diameter or mesh size of the solid bodies is between 0.1 and 5 mm.

13. A method according to claim 1, characterized in that the wood element is pressurized to between 700 and 1100 bar.

14. A method according to claim 1, characterized in that the pressure increase takes place at a rate of, on average, between 10 and 25 bar/second.

15. A method according to claim 1, characterized in that the hardness of the solid bodies exceeds IRH shore D 80°.

16. A method according to claim 1, further comprising the step of draining the liquid driven out of the wood element from the spaces.

17. A method according to claim 16, characterized in that an impregnating liquid is introduced into the wood element.

18. A method according to claim 17, characterized in that the impregnating liquid is pressurized and is supplied to the spaces in the pressure medium.

19. A method for treatment of a wood element, having a high moisture ratio, exceeding 30%, characterized by the steps of embedding the wood element in a pressure medium comprising a plurality of solid bodies with intermediate spaces, pressurizing the pressure medium such that the solid bodies transmit pressure to the wood element, whereby the wood element is compressed and a pressure difference arises between the wood element and said spaces, said pressure difference driving liquid from the wood element to the spaces, during the pressurization draining liquid that has been driven out from the wood element, and removing the pressurization, whereby the wood element is relieved and expands.

* * * * *